US007134255B2

(12) United States Patent
Monti

(10) Patent No.: US 7,134,255 B2
(45) Date of Patent: Nov. 14, 2006

(54) MACHINE FOR FILLING AND CLOSING TUBES

(75) Inventor: Guiseppe Monti, Bologna (IT)

(73) Assignee: Tonazzi Vasquall S.r.L., Cerro Maggiore (IT)

( * ) Notice: Subject to any disclaimer, the term of this patent is extended or adjusted under 35 U.S.C. 154(b) by 161 days.

(21) Appl. No.: 11/045,766

(22) Filed: Jan. 28, 2005

(65) Prior Publication Data

US 2005/0166547 A1 Aug. 4, 2005

(30) Foreign Application Priority Data

Feb. 3, 2004 (IT) ..... BO2004U0008

(51) Int. Cl.
*B65B 57/00* (2006.01)
*B65B 7/14* (2006.01)

(52) U.S. Cl. ..... 53/53; 53/467

(58) Field of Classification Search ..... 53/53, 53/415, 467, 485, 493, 250, 282
See application file for complete search history.

(56) References Cited

U.S. PATENT DOCUMENTS

| | | | | |
|---|---|---|---|---|
| 2,102,840 A | | 12/1937 | Fechheimer | |
| 2,162,464 A | * | 6/1939 | Soderberg | 53/281 |
| 3,788,035 A | * | 1/1974 | Geisel | 53/282 |
| 4,532,967 A | * | 8/1985 | Graf | 141/3 |
| 4,614,073 A | | 9/1986 | Argazzi | |
| 5,209,044 A | * | 5/1993 | D'Addario et al. | 53/469 |
| 5,775,386 A | | 7/1998 | Connan | |
| 6,082,077 A | * | 7/2000 | Christ | 53/250 |
| 6,739,111 B1 | * | 5/2004 | Banks et al. | 53/415 |
| 2003/0041918 A1 | * | 3/2003 | Christ | 141/192 |
| 2004/0187444 A1 | * | 9/2004 | Hutchinson et al. | 53/453 |
| 2005/0284103 A1 | * | 12/2005 | Hartness et al. | 53/136.1 |

FOREIGN PATENT DOCUMENTS

| | | |
|---|---|---|
| EP | 1170209 | 6/2001 |
| EP | 1170210 | 9/2002 |
| FR | 1046464 | 12/1953 |
| FR | 2564061 | 5/1985 |
| GB | 1415054 | 2/1973 |

* cited by examiner

*Primary Examiner*—Scott A. Smith
*Assistant Examiner*—Gloria R. Weeks
(74) *Attorney, Agent, or Firm*—William J Sapone; Colemna Sudol Sapone P C.

(57) ABSTRACT

In a machine for filling and closing tubes, an endless conveying line has equispaced gripping members for loading tubes with vertical axis and with open bottoms turned upwards. The line is operated stepwise for transferring the tubes, one by one, to subsequent stations arranged along the line for carrying out operations of cleaning inside the tubes, orienting outer prints, filling the tubes with measured quantities of product, closing the bottoms, applying codes, and possibly trimming the tubes. The machine includes also a station for expulsion of rejected tubes and a download station for transferring good tubes to an outlet line. Configuration of the line and arrangement of the stations are designed to reduce dimensions, simplify construction and limit costs of the machine, at the same time ensuring high reliability.

6 Claims, 1 Drawing Sheet

MACHINE FOR FILLING AND CLOSING TUBES

FIELD OF THE INVENTION

The present invention relates to filling tubes made of aluminum alloy or synthetic material, with paste products or similar.

DESCRIPTION OF THE PRIOR ART

According to the prior art, the tubes have a cylindrical shape, are open at the bottom and have an already sealed cap at top. The so prepared tubes are fed to the line of machines aimed at filling the tubes and closing their bottoms.

For this purpose, the tubes are disposed on the line in vertical position, overturned, that is with the bottom aperture turned upwards, in order to allow filling means to introduce a measured quantity of liquid or paste product into each tube.

Afterwards, the bottom of the tubes is closed, obviously in a different way, depending on the type of material of which the tubes are made, aluminium alloy or synthetic material. Some machines for filling and closing the tubes have closing means, situated in different stations, for both types of material, which are selected alternately, in relation to the kind of tube being processed.

The machines for filling and closing tubes include, upstream of the tubes filling station, a suitable station for washing the tubes inside, indispensable if the product to introduce is food, a pharmaceutical, a cosmetic or the like.

Normally, the tubes have a series of impressions, such as marks, information about contents and others, which must be in a selected position, when the tube is filled and closed.

For this purpose, the machines for filling and closing tubes have a special station, situated upstream of the closing station, in which the tubes are rotated on their vertical axis until the impressions have the desired orientation.

After the closing, and before the discharge station, the tubes can be subjected to additional operations, for example coding or trimming, as well as the control and possible rejection of defective ones.

It is intuitive to understand that each single step of the above mentioned cycle has different characteristic features and needs, which must be satisfied at the best by the respective means of the machine for filling and closing tubes.

This requires an accurate planning of the machine configuration and of different working means, in order to avoid the situations, in which the functionality of one working element limits the functionality of another one, and anyway to respect the most general needs of simplicity, reliability and compactness of the whole.

SUMMARY OF THE INVENTION

The object of the present invention is to propose a machine for filling and closing tubes, which is designed in such a way as to perform in a best way filling and closing of the tubes, with working means being properly arranged and whose total dimensions are not extended.

Another object of the present invention is to propose a machine, which allows the operator to perform easily verify, cleaning and maintenance operations.

The above mentioned objects are achieved, in accordance with the contents of the claims, by a machine for filling and closing tubes fed with bottoms open and made of metal or synthetic material, the machine including:

a conveying line extending in a horizontal plane, along an endless path and including two straight runs, a fore run and a rear run respectively;

two curved portions, a first curved portion and a second curved portion, respectively, joining said fore run and rear run to form said close loop;

gripping means arranged equispaced along said conveying line for supporting the tubes overturned with their axis vertical;

first conveying means situated at a loading station in said fore straight run of the conveying line for taking said tubes, fed one by one in a selected position by feeding means, and loading them onto said gripping means;

cleaning means situated in said fore straight run of the conveying line, downstream of said first conveying means, for cleaning inside said tubes fastened to said gripping means;

rotating mans situated in the same fore straight run, downstream of said cleaning means, for rotating said tubes on their vertical axis, so as to bring prints made on the tubes to a selected angular position;

supply means situated in a position corresponding to said first curved portion of the conveying line, for supplying batched quantities of liquid or paste product into said tubes;

first closing means for metallic tubes, situated at the beginning of the rear straight run of the conveying line, downstream of said filling station, for closing open bottoms of said metallic tubes;

second closing means for synthetic tubes, situated in said rear straight run, downstream of said first closing means, for closing open bottoms of said synthetic tubes;

code applying means, situated in said rear straight run, downstream of said second closing means, for applying a code on said tubes;

trimming means, situated in said rear straight run, downstream of said code applying means, for cutting a prefixed portions of said tubes of synthetic material, exceeding a closing line of their bottom;

a station for expulsion of rejected articles, which is situated in said second curved portion of the conveying line, downstream of said trimming means, for removing the tubes considered defective from the conveying line;

second conveying means, situated at a download station in said second curved portion, downstream of said station for rejecting defective articles, for removing the tubes from the conveying line and placing the removed tubes onto an outlet line;

motor means for intermittent operation of said conveying line according to steps equal to the distance between said gripping means.

BRIEF DESCRIPTION OF THE DRAWINGS

The characteristic features of the invention will be pointed out in the following description, in accordance with the contents of the claims and with reference to the enclosed figures, in which:

DESCRIPTION OF THE PREFERRED EMBODIMENTS

Figure 1:
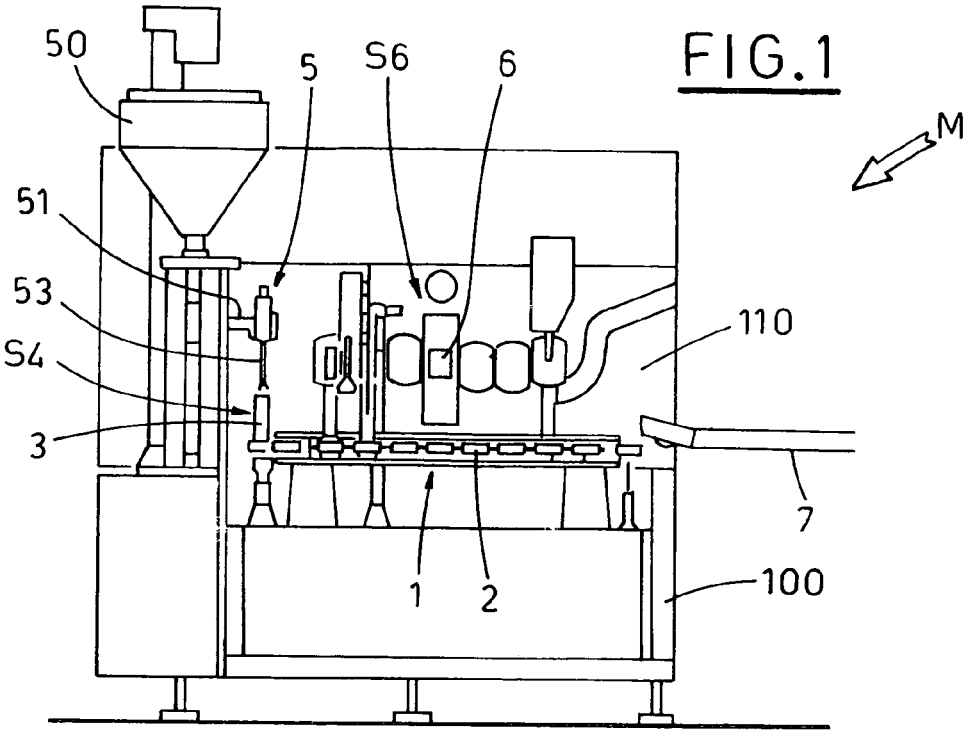
FIG. 1 is a schematic front view of the machine for filling and closing tubes proposed by the invention.
Figure 2:
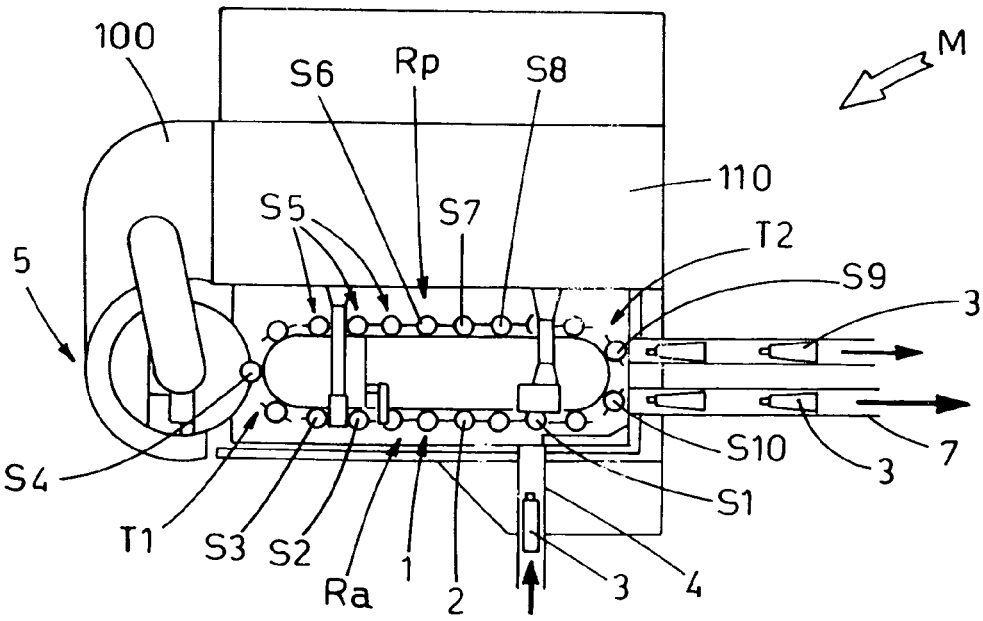
FIG. 2 is a corresponding top view of the machine of FIG. 1.

With reference to the above Figures, the proposed machine for filling and closing tubes as a whole is indicated with M.

The machine M includes a conveying line 1, extending in a horizontal plane, along an endless path defined by two straight runs, a fore run Ra and a rear run Rp, respectively, having ends connected to two curved portions, first T1 and second T2, respectively.

According to the shown non-exclusive example, the two straight runs Ra, Rp are parallel and the two curved portions T1, T2 are semicircular, with a same radius.

The rear straight run Rp is situated parallel to and beside a shoulder 110, defined by a structure 100 of the machine for filling and closing tubes M and aimed at housing mechanisms controlling working means cantilevered to the shoulder 110 and situated above the conveying line 1 and belonging to the working stations mentioned in the following.

The conveying line 1 includes gripping means 2, arranged equispaced, which support tubes 3.

The conveying line 1 is operated by related motor means, not shown, to move in an intermittent way by forward steps coinciding with the distance between the gripping means 2.

Therefore, each station works with one single tube 3.

As it has already been said in the introductory note, the tubes 3 can be made of aluminum alloy or synthetic material, and have a cylindrical shape, are open at the bottom and have an already sealed cap at top.

The tubes 3 are fed one by one in a selected position by feeding means 4 in a region corresponding to a loading station S1, situated at the beginning of the fore straight run Ra of the conveying line 1 and having first conveying means, which take the tubes 3 and load them onto the gripping means 2 in an overturned position with the axis being vertical, thus with the open bottom turned upwards.

A cleaning station S2, situated downstream of the loading station S1, in the fore straight run Ra of the conveying line 1, has means, not shown in detail since known, for cleaning each tube 3 inside.

The cleaning station S2 can be activated or deactivated in relation to the needs, which depend on the character of the product to be introduced into the tubes 3.

An orienting station S3, situated in the fore straight run Ra of the conveying line 1, downstream of the cleaning station S2, has means, not shown in detail since known, for rotating each tube 3 on its vertical axis, so as to bring the impression made on the lateral surface of the tube to a selected angular position.

A filling station S4, situated downstream of the orienting station S3, in a position corresponding to the first curved portion T1 of the conveying line 1, has supply means 5, which supply measured quantities of liquid or paste product into each tube 3.

The supply means 5 include, in a known way, a hopper 50, from which the product is taken and introduced into a batcher 51, for example a syringe, communicating with a nozzle 53, situated above the open bottom of a relative tube 3, dwelling in the filling station S4.

The supply means 5 are for example fastened to the structure 100 and to the relative operating means by quick connection means, so that the whole group can be entirely and easily removed from the machine to be cleaned.

At least one first closing station S5 for metallic tubes 3 is situated at the beginning of the rear straight run Rp of the conveying line 1, after the first curved portion T1, thus downstream of the filling station S4.

According to a preferred embodiment, shown in the Figures, the operations of closing the metallic tubes 3 bottoms are divided in more subsequent substations, to avoid constructive complications of the operating means.

The operating means, known and not shown, are suitably activated if metallic tubes 3 are fed to the conveying line 1, or deactivated if the fed tubes are of synthetic material.

A second closing station S6 for tubes 3 made of synthetic material, is situated in the same rear straight run Rp of the conveying line 1 and its operating means are activated or deactivated alternately to those of the previous first closing station S5.

According to a non-exclusive example, the closing means for tubes 3 made of synthetic material include heat-welding means connected to a head 6, which moves vertically and is lowered onto the tube 3 dwelling in the station, so as to act on the open bottom of the latter.

A code applying station S7, situated after the second closing station S6, in the rear straight run Rp of the conveying line 1, has means, likewise known, for applying a prefixed code onto each tube 3.

The working means of the last station are activated or deactivated, when needed.

A trimming station S8, situated in the terminal part of the rear straight run Rp, has cutting means, which act on the prefixed portions of the tubes 3 of synthetic material, exceeding the bottom closing line.

Obviously, the working means of the trimming station S8 are activated only when synthetic tubes are processed.

A station S9 for expulsion of rejected articles, is situated in the second curved portion T2 of the conveying line 1, downstream of the trimming station S8.

The tubes 3 considered defective are removed from the conveying line 1 in the station S9 and conveyed to e.g. a collecting container or the like.

The remaining tubes 3, that is the "good" ones, are downloaded from the conveying line 1 in a discharge station S10, situated immediately downstream, in the second curved portion T2, by second conveying means, which take the good tubes 3 from the gripping means 2 and introduce them into an outlet line 7.

The advantages of the proposed machine M result apparent from the above description.

First of all, as far as the choice to work on only one tube 3 in each station is concerned, it derives from the intention to maintain the line dimensions small, to simplify the working means conformation and to reduce the machine total cost, maintaining its high reliability.

The shape of the conveying line 1, endless with two parallel runs and semicircular connections, allows advantages of simplicity of the normal straight open lines added to the ones of a turret machine, but with reduced dimensions.

The location of the filling station S4 in a curved portion of the conveying line 1 is particularly advantageous to reduce to the minimum the area of the conveying line 1, which can be soiled with product; this configuration allows wider space outside for housing the group of the supply means 5 and, last but not least, easy dismantling and reassembling operations of the latter.

The shoulder conformation of the machine M structure is in the proposed case an extremely advantageous solution, for cleaning the tubes inside, visibility and accessibility of the whole line, as well as for suitability, if a working area with a controlled atmosphere is to be created by using laminar flows.

Moreover, the shoulder 110, which carries cantilevered thereto the working means of the stations, is advantageously situated on this part of the rear straight run Rp of the conveying line 1, in which the most complicated constructively stations are situated, so as to reduce the cantilevered sections of these means, which results in obvious advantages.

The downloading station S10 is located close to the initial loading station S1, so that the operator can easily watch both entrance and exit of the tubes 3.

Finally, the proposed machine is compact, functional and easy for verify, cleaning and maintenance operations.

Moreover, it has a complete equipment for working with tubes made of metal as well as of synthetic material.

What is claimed is:

1. A machine for filling and closing tubes fed with bottoms open and made of metal or synthetic material, the machine including:

a conveying line extending in a horizontal plane, along an endless path and including two straight runs, a fore run and a rear run respectively;

two curved portions, a first curved portion and a second curved portion, respectively, joining said fore run and rear run to form said close loop;

gripping means arranged equispaced along said conveying line for supporting the tubes overturned with their axis vertical;

first conveying means situated at a loading station in said fore straight run of the conveying line for taking said tubes, fed one by one in a selected position by feeding means, and loading them onto said gripping means;

cleaning means situated in said fore straight run of the conveying line, downstream of said first conveying means, for cleaning inside said tubes fastened to said gripping means;

rotating mans situated in the fore straight run, downstream of said cleaning means, for rotating said tubes on their vertical axis, so as to bring prints made on the tubes to a selected angular position;

supply means situated in a position corresponding to said first curved portion of the conveying line, for supplying batched quantities of liquid or paste product into said tubes;

first closing means for metallic tubes, situated at the beginning of the rear straight run of the conveying line, downstream of said supply means, for closing open bottoms of said metallic tubes;

second closing means for synthetic tubes, situated in said rear straight run, downstream of said first closing means, for closing open bottoms of said synthetic tubes;

code applying means, situated in said rear straight run, downstream of said second closing means, for applying a code on said tubes;

trimming means, situated in said rear straight run, downstream of said code applying means, for cutting a prefixed portions of said tubes of synthetic material, exceeding a closing line of their bottom;

a station for expulsion of rejected articles, which is situated in said second curved portion of the conveying line, downstream of said trimming means, for removing the tubes considered defective from the conveying line;

second conveying means, situated at a download station in said second curved portion, downstream of said station for rejecting defective articles, for removing the tubes from the conveying line and placing the removed tubes onto an outlet line;

motor means for intermittent operation of said conveying line according to steps equal to the distance between said gripping means;

first operating means for operating said first closing means and second operating means for operating said second closing means, said first operating means being activated or deactivated alternately to the second operating means.

2. A machine as claimed in claim 1, wherein said fore straight run and rear straight run of the conveying line are parallel and said curved joining portions are semicircular and have the same radius.

3. A machine as claimed in claim 1, wherein said rear straight run of the conveying line is situated parallel and beside a shoulder defined by said machine for housing mechanisms controlling operation of said machine.

4. A machine as claimed in claim 1, wherein said supply means are removably fastened to said machine by quick connection means.

5. A machine as claimed in claim 1, wherein said means situated in said second closing station for tubes of synthetic material, include heat-welding means, connected to a vertically movable head lowered, in operation, onto a tube dwelling at said second closing means.

6. A machine as claimed in claim 1, wherein said download station is located on said conveying line near said loading station.

* * * * *